United States Patent [19]

Eschenbach

[11] 4,351,148

[45] Sep. 28, 1982

[54] FALSE TWISTED SLUB YARN

[75] Inventor: Paul W. Eschenbach, Moore, S.C.

[73] Assignee: Milliken Research Corporation, Spartanburg, S.C.

[21] Appl. No.: 223,273

[22] Filed: Jan. 8, 1981

Related U.S. Application Data

[62] Division of Ser. No. 93,199, Nov. 13, 1979, Pat. No. 4,305,245.

[51] Int. Cl.[3] ..... D02G 3/34

[52] U.S. Cl. ..... 57/209; 57/208; 57/908

[58] Field of Search ..... 57/206, 207, 208, 209, 57/908, 6, 245, 282, 285, 289, 351

[56] References Cited

U.S. PATENT DOCUMENTS

| | | | |
|---|---|---|---|
| 3,174,271 | 3/1965 | Edwards et al. | 57/908 X |
| 3,438,194 | 4/1969 | Cerutti et al. | 57/206 |
| 3,640,064 | 2/1972 | Palm et al. | 57/91 X |
| 4,010,601 | 3/1977 | Anahara et al. | 57/91 X |
| 4,112,561 | 9/1978 | Norris et al. | 57/91 X |
| 4,152,886 | 5/1979 | Nelson | 57/208 |
| 4,159,619 | 7/1979 | Griset | 57/209 X |
| 4,170,865 | 10/1979 | Pike | 57/91 X |
| 4,218,869 | 8/1980 | Newton | 57/351 X |
| 4,219,997 | 9/1980 | Hatcher | 57/245 |
| 4,244,171 | 1/1980 | Sasaki | 57/208 |
| 4,288,640 | 10/1980 | Talbot | 57/208 |

*Primary Examiner*—Donald Watkins

*Attorney, Agent, or Firm*—Earle R. Marden; H. William Petry

[57] ABSTRACT

Apparatus and method to provide a novel false twisted slub yarn by combining a core yarn and an effect yarn in a fluid tangling zone. The linear velocity of the effect yarn is raised to allow slubs to be produced in the combined yarn in an air jet apparatus.

4 Claims, 3 Drawing Figures

FALSE TWISTED SLUB YARN

This is a division of application Ser. No. 093,199, filed Nov. 13, 1979, now U.S. Pat. No. 4,305,245.

This invention relates generally to novelty yarns produced by combining a false twisted core yarn and a false twisted effect yarn in an air jet to supply a continuous, multi-filament slub yarn.

It is therefore an object of the invention to provide an apparatus and method to produce a novelty, multi-filament yarn.

Other objects and advantages of the invention will become readily apparent as the specification proceeds to describe the invention with reference to the accompanying drawings, in which.

and

Figure 1:
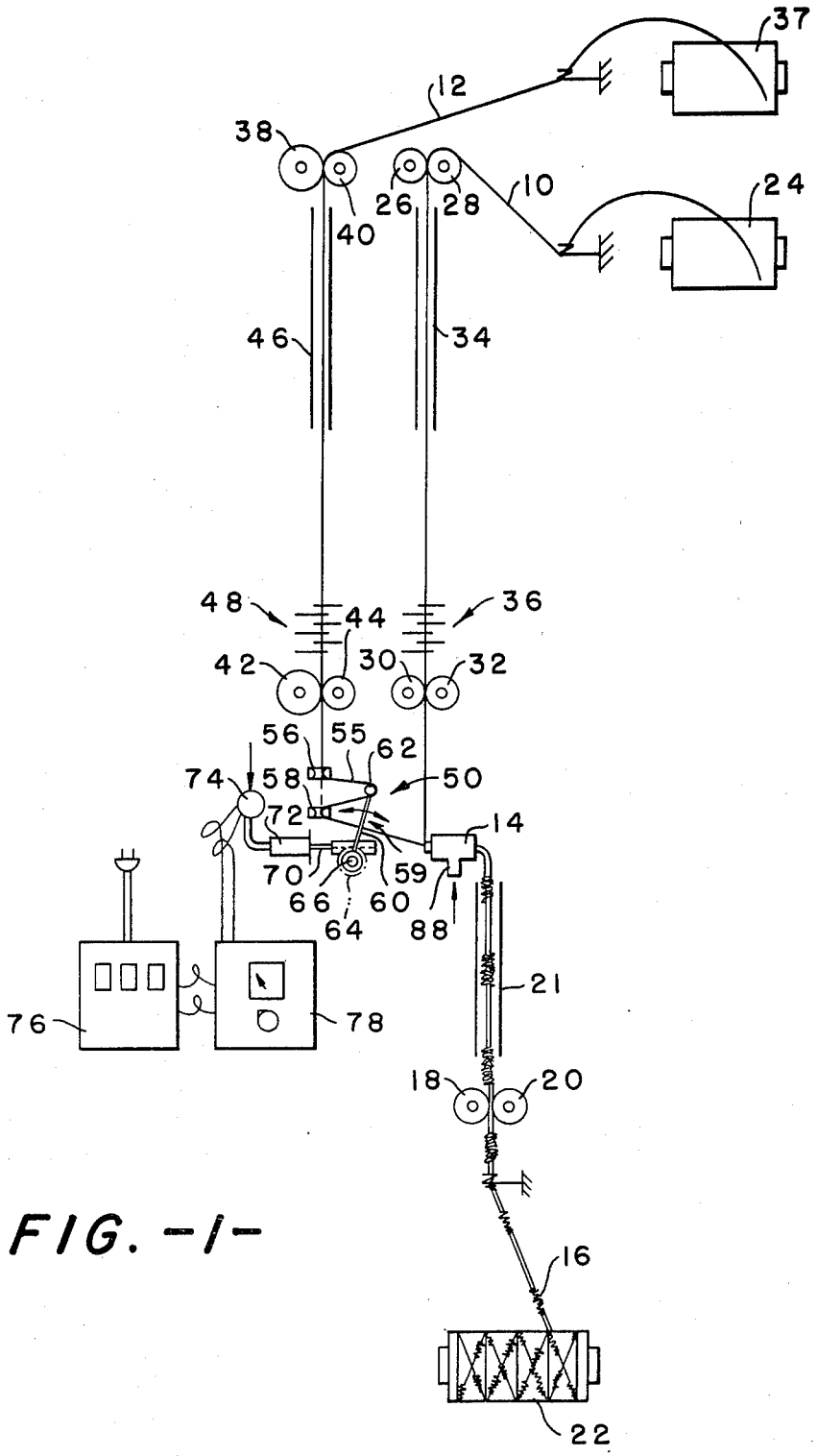
FIG. 1 is a schematic representation of the apparatus and method to produce the novel yarn.
Figure 2:
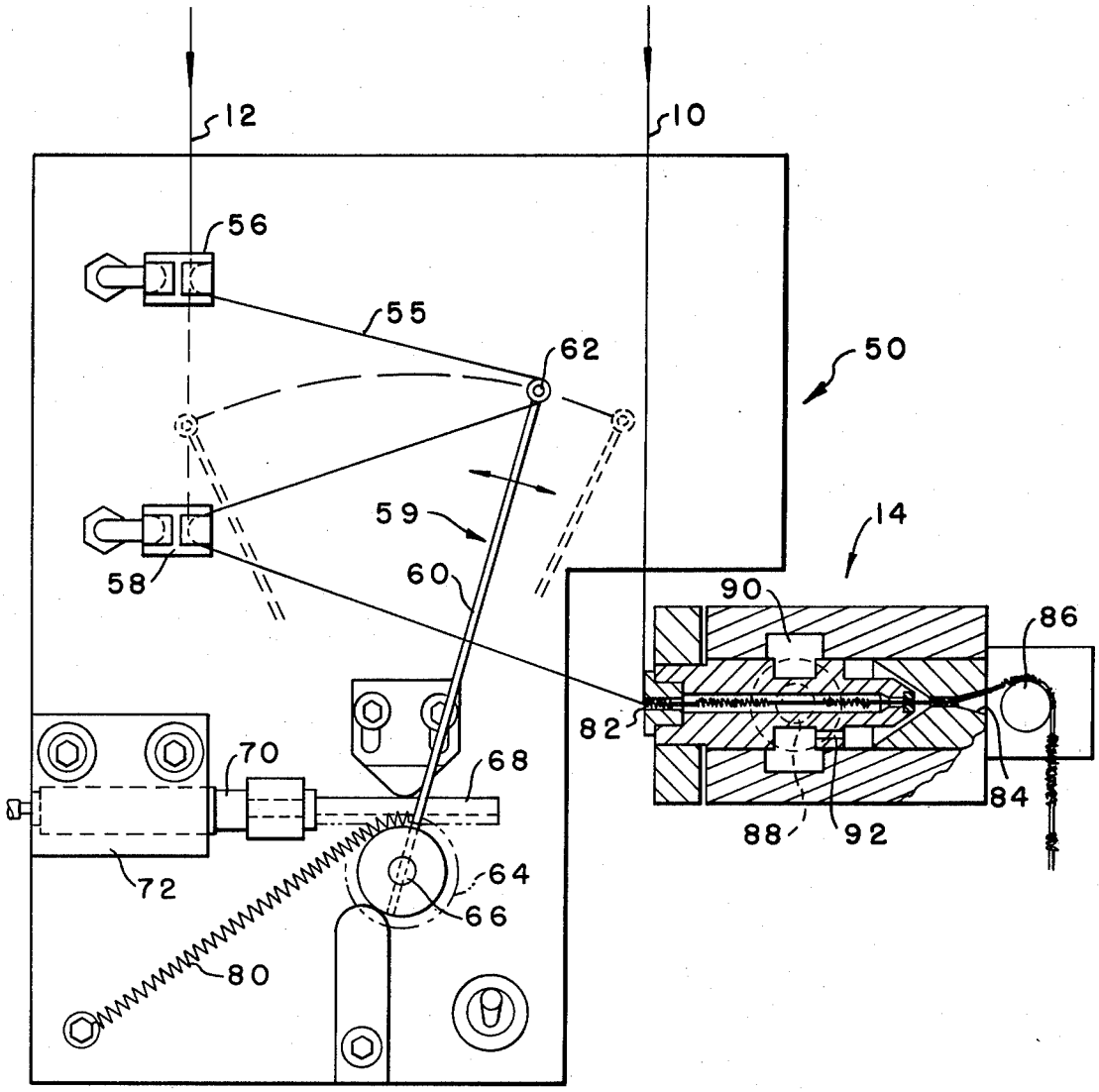
FIG. 2 is a blown-up view of the apparatus employed to cause a deviation of the effect yarn path through the apparatus.
Figure 3:
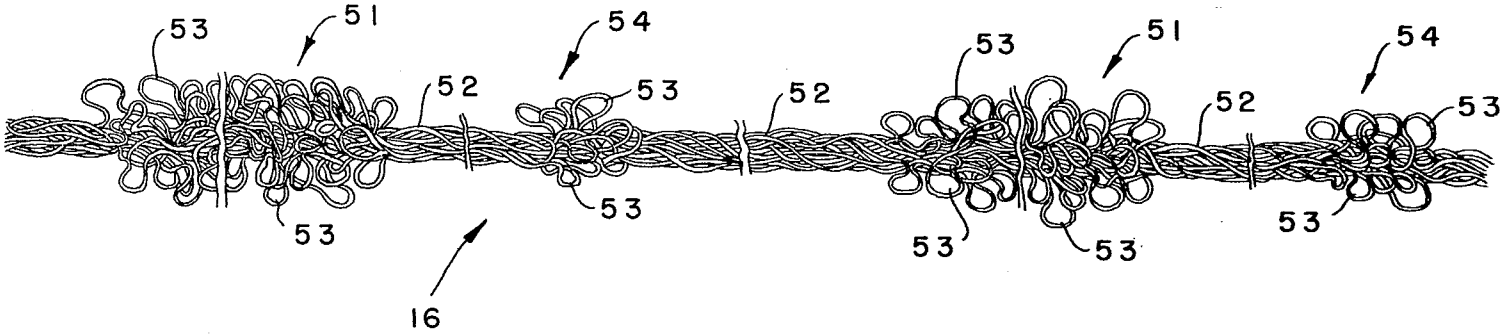

FIG. 3 is a schematic representation of the yarn produced by the apparatus of FIGS. 1 and 2.

Looking now to FIG. 1 there is shown one embodiment of an apparatus for producing novelty yarn composed of a core yarn and an effect yarn. In the preferred form of the invention, both the core yarn 10 and the effect yarn 12 are continuous, multi-filament, partially oriented polyester yarns but, obviously, other partially oriented or fully oriented synthetic, continuous, multi-filament yarns such as nylon, Dacron, etc. can be employed, if desired.

The core and effect yarns 10 and 12 are combined in the air jet 14 to produce the slub yarn 16 which is delivered by the takeup nip rolls 18 and 20 through the secondary heater 21 to the takeup roll 22. The core yarn 10 is delivered from the package 24 to the false twist zone by the first delivery rolls 26 and 28. The second delivery rolls 30 and 32 draw the core yarn 10 as it passes through the primary heater 34 and the false twist device 36, illustrated as friction discs, and supplies it to the air jet 14.

The effect yarn 12 is delivered from the package 37 to the false twist zone by the first delivery rolls 38 and 40 and is drawn by the second delivery rolls 42 and 44 as it passes through the primary heater 46 and false twist device 48, illustrated as friction discs. From the delivery rolls 42 and 44, the effect yarn 12 is delivered to the air jet 14 through the path deviation device 50 which operates in a manner hereinafter explained.

The speeds of the delivery rolls are pre-selected to provide a desired result in the yarn produced. In the preferred form of the invention, the speed of the rolls 26, 28, 38 and 40 is so selected that the speed of the effect yarn 12 being delivered thereby is greater than the speed of the core yarn 10. The speeds of the delivery rolls 30, 32, 42 and 44 are so selected that the delivery speed of the effect yarn 12 is greater than the speed of the core yarn 10. In the preferred form of the invention, since partially oriented yarn is being run, the speeds of rolls 30, 32, 42 and 44 are so selected to draw the effect and core yarns. The speed of the delivery rolls 18 and 20 is so selected that the slub yarn 16 delivered therefrom is at a speed lower than the speed of either the core yarn 10 or the effect yarn 12, respectively, from the rolls 30 and 32 or 42 and 44.

The combined yarn 16 consists of slub sections 51, lean sections 52 and nubs 54. The slub sections 51 and the nubs 54 are denser than the lean sections and contain a plurality of substantially circular loops 53 having a diameter range of 0.003" to 0.010". As will be hereinafter explained the length of the slub sections and lean sections is randomly selected, but the nubs shall always be shorter in length than the slubs and closely adjacent thereto.

The slubs sections 52 and nubs 54 are basically allowed to form by the path deviation device 50 which controls the path and consequently the velocity of the effect yarn 12. The core yarn 10 is supplied directly from the delivery rolls 32 into the entrance of the air jet 14 while the effect yarn 12 is supplied from the delivery rolls 42 and 44 through the guide members 56 and 58 then into the air jet. When the path deviation device 50 is not actuated the yarn 12 will pass straight downwardly through the guide members 56 and 58, as indicated by dotted lines, and then be directed into the conventional air jet 14 wherein it is commingled with the core yarn 10 to form yarn represented by the lean section 52.

The yarn deviation device 50 consists of a rod 59 with an elongated body portion 60 and a finger portion 62 perpendicular to the body portion 60. The rod is fixed to a gear 64 freely rotatable on stub shaft 66 with the gear teeth in engagement with the gear teeth of a rack 68. The rack 68 is connected to the piston rod 70 of an air cylinder 72 supplied air under pressure through a solenoid operated valve 74. The actuation of the solenoid valve is controlled by a random signal generator 76 of the type disclosed in U.S. Pat. No. 4,160,359 which randomly supplies pulses to the DC power supply 78 to cause power to be supplied randomly to the solenoid valve 74. When the solenoid valve is activated, air is supplied to air cylinder 72 to move the piston rod 70 outwardly to the position shown in FIGS. 1 and 2 against the bias of spring 80 to rotate the gear 64 clockwise to pivot the rod 59 to the position shown. When the rod 59 is pivoted, the finger portion 62 contacts the effect yarn 12 and lengthens the path of travel thereof. By lengthening the path of travel of the yarn 12 in this manner, the linear velocity of the effect yarn being supplied to the air jet 14 is reduced to about the linear velocity of the core yarn 10. When the solenoid valve 74 is deactivated, the air will be exhausted from the air cylinder 72 and the spring 80 will immediately rotate the rod in a counterclockwise releasing the yarn 12 between the guide members 56 and 58. When the yarn 12 is released and accumulated yarn loop 55 and the excess yarn therein is sucked into the air jet and the filaments therein are expanded and allowed to curl into the substantially circular yarn loops 53 which are intermingled with the filaments of the core yarn 10 until the excess yarn in the loop 55 is taken up and the velocity of the core and effect yarns stabilizes and forms a lean section 52.

In the preferred form of the invention, the spring 80 is so selected to allow the rod 59 to bounce when it reaches the extreme left hand position (FIGS. 1 and 2) upon exhaustion of air from the cylinder 72 to form a small loop in the yarn 12, similar to the loop 55, and then when it comes to rest the smaller nub 54 will be formed in the combined yarn 16 in the same manner that the slub 51 is formed. This results in a yarn like that that is shown in FIG. 3 having randomly and sequentially a slub portion 51, a lean portion 52, a nub 54 closely adjacent the slub portion 51, a lean portion 52 and a repeat of this sequence.

The air jet 14 is a commercially available type and does not per se form a part of the invention other than that it accomplishes the desired result of combing the yarn as shown in FIG. 3. The core yarn 10 and the effect 12 are supplied into the air jet 14 through the entrance 82 and the combined yarn exits through the outlet 84, partially encircles the air impact device 86 and is directed to the take-up roll 22 by the delivery rolls 18 and 20. Air under pressure is supplied into the air jet 14 via conduit 88 into the pressure chamber 90 from whence it is directed against the yarns 10 and 12 through passages 92 and is ejected out the outlet 84 against the air impact device 86. The device 86 acts to increase turbulence in the jet 14 to enhance the commingling of the yarn filaments and increase the velocity of the yarn through the air jet 14.

The following is an example of the production of a slub yarn in the manner hereinbefore described.

EXAMPLE

The core and effect yarns are both 190 denier, 68 filament, 56T, partially oriented polyester yarn. The resultant combined yarn is 270 denier polyester yarn having slubs in the range of 2"–4½" in length and nubs in the range of ¼"–¾" in length.

The combined yarn is formed under the following parameters:

- Effect yarn velocity from first delivery rolls—252 meters/minute
- Core yarn velocity from first delivery rolls—216 meters/minute
- Primary heater temperature—207° C.
- Effect yarn velocity from second delivery rolls—409 meters/minute
- Core yarn velocity from second delivery rolls—345 meters/minute
- Stroke of rod 59—3"
- Air pressure to air jet—140 psi
- Random signal generator on for about 0.15 to 0.30 seconds and off for 0.02 seconds
- Secondary heater off
- Combined yarn velocity from take-up rolls—296 meters/minute
- Combined yarn take-up velocity—322 meters/minute It is obvious that a false twist textured slub yarn has been provided by efficiently combining a core yarn and an effect yarn is a novel apparatus which employs air under pressure to commingle and slub the filaments of the core and effect yarns.

Although the preferred embodiment of the invention has been described specifically, it is contemplated that many changes may be made without departing from the scope or spirit of the invention, and I desire to be limited only by the claims.

I claim:

1. A novel slub yarn comprising: at least two commingled, false twisted, multi-filament, continuous synthetic yarns having a plurality of slubs spaced along the length thereof and each of said slubs having a nub closely adjacent thereto, said nub having a length substantially less than the length of said slubs, said slub and said nub having substantially the same false twist therein.

2. The yarn of claim 1 wherein a plurality of the filaments in said slubs and said nubs have substantially circular coils therein.

3. The yarn of claim 1 wherein said slubs and nubs are randomly spaced throughout said yarn.

4. The yarn of claim 3 wherein a plurality of the filaments in said slubs and said nubs have substantially circular coils therein.

* * * * *